US010699643B2

(12) United States Patent
Yuan et al.

(10) Patent No.: US 10,699,643 B2
(45) Date of Patent: Jun. 30, 2020

(54) PIXEL DRIVING COMPENSATION CIRCUIT, DRIVING COMPENSATION METHOD THEREFOR AND DISPLAY DEVICE

(71) Applicants: Hefei Xinsheng Optoelectronics Technology Co., Ltd., Hefei, Anhui (CN); BOE TECHNOLOGY GROUP CO., LTD., Beijing (CN)

(72) Inventors: Can Yuan, Beijing (CN); Zhidong Yuan, Beijing (CN); Yongqian Li, Beijing (CN); Pan Xu, Beijing (CN); Wenchao Bao, Beijing (CN); Min He, Beijing (CN)

(73) Assignees: Hefei Xinsheng Optoelectronics Technology Co., Ltd, Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/334,114

(22) PCT Filed: Jan. 4, 2018

(86) PCT No.: PCT/CN2018/071370
§ 371 (c)(1),
(2) Date: Mar. 18, 2019

(87) PCT Pub. No.: WO2018/201749
PCT Pub. Date: Nov. 8, 2018

(65) Prior Publication Data

US 2019/0371245 A1 Dec. 5, 2019

(30) Foreign Application Priority Data

May 4, 2017 (CN) ..... 2017 1 0308784

(51) Int. Cl.
*G09G 3/3233* (2016.01)
*G09G 3/3258* (2016.01)
*G09G 3/3275* (2016.01)

(52) U.S. Cl.
CPC ..... *G09G 3/3258* (2013.01); *G09G 3/3233* (2013.01); *G09G 3/3275* (2013.01)

(58) Field of Classification Search
CPC ..... G09G 3/3233; G09G 3/3258
See application file for complete search history.

(56) References Cited

U.S. PATENT DOCUMENTS 9,035,976 B2 5/2015 Lee et al.
9,076,387 B1 * 7/2015 Lee ..... G09G 3/20
(Continued)

FOREIGN PATENT DOCUMENTS

CN 101859529 A 10/2010
CN 103578411 A 2/2014
(Continued)

OTHER PUBLICATIONS

International Search Report and Written Opinion dated Mar. 30, 2018, from application No. PCT/CN2018/071370.

*Primary Examiner* — Roy P Rabindranath
(74) *Attorney, Agent, or Firm* — Foley & Lardner LLP

(57) ABSTRACT

The present disclosure relates to a pixel driving compensation circuit. The pixel driving compensation circuit can detect and compensate a driving current of a sub-pixel in a pixel unit. The pixel unit includes first, second, and third sub-pixels and the first to third sub-pixels respectively include first, second, and third driving transistors. The pixel driving compensation circuit includes a first switching sub-circuit configured to be turned on in a first period to transmit a driving current output from the first driving transistor to a first detection line, second switching sub-circuit configured to be turned on in a second period to transmit a driving
(Continued)

current output from the second driving transistor to a first detection line, and a third switching sub-circuit configured to be turned on in the first period to transmit a driving current output from the third driving transistor to a second detection line.

20 Claims, 6 Drawing Sheets

(56) References Cited

U.S. PATENT DOCUMENTS

| | | | | |
|---|---|---|---|---|
| 9,460,661 | B2 | 10/2016 | Shim et al. | |
| 2009/0303162 | A1 | 12/2009 | Kohno et al. | |
| 2010/0253659 | A1 | 10/2010 | Sugimoto et al. | |
| 2014/0022289 | A1* | 1/2014 | Lee | G09G 3/3283 345/691 |
| 2015/0123953 | A1 | 5/2015 | Shim et al. | |
| 2017/0092376 | A1 | 3/2017 | Wang | |
| 2017/0169767 | A1* | 6/2017 | Song | G09G 3/3241 |
| 2018/0061913 | A1* | 3/2018 | Kim | G09G 3/3225 |
| 2019/0066588 | A1* | 2/2019 | Lin | G09G 3/3233 |

FOREIGN PATENT DOCUMENTS

| | | | |
|---|---|---|---|
| CN | 104637440 | A | 5/2015 |
| CN | 104715733 | A | 6/2015 |
| CN | 107086023 | A | 8/2017 |
| GB | 2 504 163 | A | 1/2014 |
| GB | 2 504 163 | B | 12/2014 |
| JP | 2009-294376 | A | 12/2009 |

* cited by examiner

PIXEL DRIVING COMPENSATION CIRCUIT, DRIVING COMPENSATION METHOD THEREFOR AND DISPLAY DEVICE

CROSS-REFERENCE TO RELATED APPLICATIONS

The present application is based upon International Application No. PCT/CN2018/071370, filed on Jan. 4, 2018, which claims the priority to the Chinese Patent Application No. 201710308784.8, entitled "PIXEL DRIVING COMPENSATION CIRCUIT AND DRIVING COMPENSATION METHOD THEREOF, DISPLAY DEVICE", filed on May 4, 2017, the entire contents of which are hereby incorporated by reference.

TECHNICAL FIELD

The present disclosure relates to the field of display technologies, and in particular, to a pixel driving compensation circuit, a driving compensation method thereof, and a display device.

BACKGROUND

OLED (Organic Light Emitting Diode) display, as a current-type light emitting device, is increasingly used in high-performance display fields due to its self-luminous, fast response, wide viewing angle, and ability to be fabricated on flexible substrates. According to the driving manner, the OLED can be classified into PMOLED (Passive Matrix Driving OLED) and AMOLED (Active Matrix Driving OLED). As the AMOLED display has the advantages of low manufacturing cost, high response speed, power saving, DC drive for portable equipment, wide operating temperature range and so on, the AMOLED display is expected to become a next-generation flat panel display replacing LCD (Liquid Crystal Display).

Existing OLED displays can use external compensation techniques to enhance display effect, such as obtaining drive current output by a driving transistor through a detection circuit and comparing it with the actual required reference current to achieve compensation. However, due to limitation of processes, many pixel defects may occur in the manufacturing process of the OLED display panel, and once a defect occurs in a certain sub-pixel, detection accuracy of other sub-pixels is also affected, which brings some difficulties to the compensation of the pixel, thus easily causing display abnormality.

SUMMARY

According to an aspect of the present disclosure, there is provided a pixel driving compensation circuit configured to detect and compensate a driving current of a sub-pixel in a pixel unit. The pixel unit includes first to third sub-pixels and the first to third sub-pixels respectively include first to third driving transistors. The pixel driving compensation circuit includes a first switching sub-circuit. The first switching circuit is configured to be turned on in a first period in response to a first strobe signal to transmit a driving current output from the first driving transistor to a first detection line. The pixel driving compensation circuit includes a second switching sub-circuit. The second switching circuit is configured to be turned on in a second period in response to a second strobe signal to transmit a driving current output from the second driving transistor to a first detection line.

The pixel driving compensation circuit includes a third switching sub-circuit. The third switching circuit is configured to be turned on in the first period in response to the first strobe signal to transmit a driving current output from the third driving transistor to a second detection line.

In an exemplary arrangement of the present disclosure, the pixel unit further includes a fourth sub-pixel and the fourth sub-pixel includes a fourth driving transistor. The pixel driving compensation circuit further includes a fourth switching sub-circuit. The fourth switching circuit is configured to be turned on in the second period in response to the second strobe signal to transmit a driving current output from the fourth driving transistor to the second detection line.

In an exemplary arrangement of the present disclosure, the pixel driving compensation circuit further includes a first reset sub-circuit configured to be turned on in response to a third strobe signal to transmit a voltage signal of the first detection line to an output terminal of the first driving transistor. The pixel driving compensation circuit further includes a second reset sub-circuit configured to be turned on in response to the third strobe signal to transmit the voltage signal of the first detection line to an output terminal of the second driving transistor. The pixel driving compensation circuit further includes a third reset sub-circuit configured to be turned on in response to the third strobe signal to transmit a voltage signal of the second detection line to an output terminal of the third driving transistor.

In an exemplary arrangement of the present disclosure, the pixel driving compensation circuit further includes a fourth reset sub-circuit configured to be turned on in response to the third strobe signal to transmit the voltage signal of the second detection line to an output terminal of the fourth driving transistor.

In an exemplary arrangement of the present disclosure, all of the switching sub-circuits and the reset sub-circuits are N-type thin film transistors or are P-type thin film transistors.

In an exemplary arrangement of the present disclosure, the first detection line and the second detection line are further connected to a driving chip.

In an exemplary arrangement of the present disclosure, the first to fourth sub-pixels include a red sub-pixel, a green sub-pixel, a blue sub-pixel, and a white sub-pixel.

According to another aspect of the present disclosure, there is provided a driving compensation method based on the pixel driving compensation circuit described above, for detecting and compensating a driving current of a sub-pixel in a pixel unit. The driving compensation method includes turning on a first switching sub-circuit and a third switching sub-circuit in a first period by the first strobe signal, and turning off a second switching sub-circuit in the first period by the second strobe signal. As such, a driving current output from a first driving transistor is transmitted to a first detection line through the first switching sub-circuit and fed back to a driving module, and a driving current output from a third driving transistor is transmitted to a second detection line through the third switching sub-circuit and fed back to the driving module. The driving module respectively reads the driving current output from the first driving transistor and the driving current output from the third driving transistor, and calculates a compensation voltage of a first sub-pixel and a compensation voltage of a third sub-pixel. The method includes turning off the first switching sub-circuit and the third switching sub-circuit in a second period by the first strobe signal, and turning on the second switching sub-circuit in the second period by the second strobe signal. As such, a driving current output by a second driving transistor is transmitted to the first detection line through the second switching sub-circuit and fed back to the driving module, and the driving module reads the driving current output by the second driving transistor and calculates a compensation voltage of a second sub-pixel.

In an exemplary arrangement of the present disclosure, in a case where the pixel unit includes a fourth sub-pixel, the driving compensation method further includes turning off a fourth switching sub-circuit in the first period by the second strobe signal when turning on the first switching sub-circuit and the third switching sub-circuit in the first period by the first strobe signal, and turning off the second switching sub-circuit in the first period by the second strobe signal. The driving compensation method further includes turning on the fourth switching sub-circuit in the second period by the second strobe signal when turning off the first switching sub-circuit and the third switching sub-circuit in the second period by the first strobe signal, and turning on the second switching sub-circuit in the second period by the second strobe signal. As such, a driving current output by a fourth driving transistor is transmitted to the second detection line through the fourth switching sub-circuit and fed back to the driving module, and the driving module reads the driving current output by the fourth driving transistor and calculates a compensation voltage of the fourth sub-pixel.

In an exemplary arrangement of the present disclosure, in a compensation phase, a high level period of a first data signal of the first sub-pixel and a third data signal of the third sub-pixel is the same as a high level period of the first strobe signal. A high level period of a second data signal of the second sub-pixel and a fourth data signal of the fourth sub-pixel is the same as a high level period of the second strobe signal. Or, a low level period of the first data signal of the first sub-pixel and the third data signal of the third sub-pixel is the same as a low-level period of the first strobe signal. A low level period of the second data signal of the second sub-pixel and the fourth data signal of the fourth sub-pixel is the same as a low level period of the second strobe signal.

In an exemplary arrangement of the present disclosure, the driving compensation method further includes turning on the first to third switching sub-circuits through the first strobe signal and the second strobe signal, and transmitting the voltage signal of the first detection line to the output terminals of the first driving transistor and the second driving transistor respectively and transmitting the voltage signal of the second detection line to the output terminal of the third driving transistor.

In an exemplary arrangement of the present disclosure, the driving compensation method further includes turning on the fourth switching sub-circuit by the second strobe signal, and transmitting the voltage signal of the second detection line to the output terminal of the fourth driving transistor.

In an exemplary arrangement of the present disclosure, in a case where the pixel driving compensation circuit further includes first to third reset sub-circuits, the driving compensation method further includes turning on the first to third reset sub-circuits respectively by a third strobe signal, transmitting the voltage signal of the first detection line to the output terminals of the first driving transistor and the second driving transistor respectively and transmitting the voltage signal of the second detection line to the output terminal of the third driving transistor.

The first switching sub-circuit and the first reset sub-circuit are simultaneously turned on, the second switching sub-circuit and the second reset sub-circuit are simultaneously turned on, and the third switching sub-circuit and the third reset sub-circuit are simultaneously turned on.

In an exemplary arrangement of the present disclosure, in a case where the pixel driving compensation circuit further includes a fourth reset sub-circuit, the driving compensation method further includes turning on the fourth reset sub-circuit by a third strobe signal, and transmitting a voltage signal of the second detection line to an output terminal of the fourth driving transistor.

The fourth switching sub-circuit and the fourth reset sub-circuit are simultaneously turned on.

According to an aspect of the present disclosure, there is provided a display device, including the above-described pixel driving compensation circuit.

It is to be understood that the above general description and the following detailed description are merely exemplary and explanatory and should not be construed as limiting of the present disclosure.

BRIEF DESCRIPTION OF THE DRAWINGS

The accompanying drawings, which are incorporated in the specification and constitute a part of the specification, show exemplary arrangements of the present disclosure. The drawings along with the specification explain the principles of the present disclosure. It is apparent that the drawings in the following description show only some of the embodiments of the present disclosure, and other drawings may be obtained according to these drawings by those skilled in the art without creationary labor.

DETAILED DESCRIPTION

Figure 1:
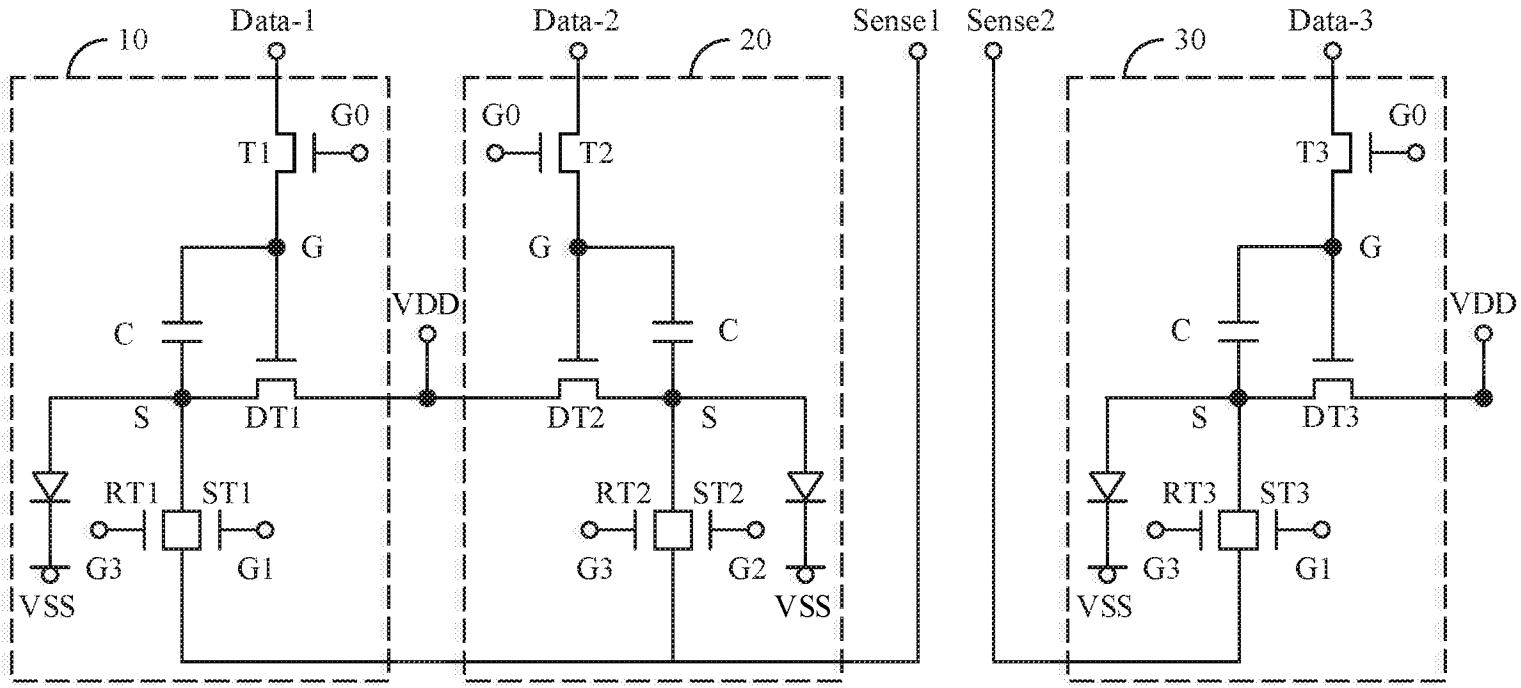
FIG. 1 schematically illustrates a schematic diagram 1 of a pixel driving compensation circuit in an exemplary arrangement of the present disclosure.

Example arrangements will now be described more fully with reference to the accompanying drawings. However, the arrangements can be implemented in a variety of forms and should not be construed as being limited to the examples set forth herein; rather, these arrangements are provided so that this disclosure will be more complete so as to convey the idea of the exemplary arrangements to those skilled in this art. The described features, structures, or characteristics may be combined in one or more arrangements in any suitable manner.

In addition, the drawings are merely schematic representations of the present disclosure and are not necessarily drawn to scale. The same reference numerals in the drawings denote the same or similar parts, and the repeated description thereof will be omitted. Some of the block diagrams shown in the figures are functional entities and do not necessarily correspond to physically or logically separate entities. These functional entities may be implemented in software, or implemented in one or more hardware modules or integrated circuits, or implemented in different networks and/or processor devices and/or microcontroller devices.

The exemplary arrangement provides a pixel driving compensation circuit, configured to detect and compensate a driving current of each sub-pixel in an OLED pixel unit. As shown in FIG. 1, the OLED pixel unit may at least include a first sub-pixel 10, a second sub-pixel 20, and a third sub-pixel 30. The first sub-pixel 10 may include a first driving transistor DT1, a first terminal of the driving transistor DT1 receives a first voltage signal VDD, and a second terminal of the driving transistor DT1 is connected to a first OLED lighting unit. The second sub-pixel 20 may include a second driving transistor DT2, a first terminal of the second driving transistor DT2 receives the first voltage signal VDD, and a second terminal of the second driving transistor DT2 is connected to a second OLED light emitting unit. The third sub-pixel 30 may include a third driving transistor DT3, a first terminal of the third driving transistor DT3 receives the first voltage signal VDD, and a second terminal of the third driving transistor DT3 is connected to a third OLED lighting unit.

Based on this, the OLED pixel driving compensation circuit may include a first switching sub-circuit ST1 corresponding to the first sub-pixel 10, a second switching sub-circuit ST2 corresponding to the second sub-pixel 20, and a third switching sub-circuit ST3 corresponding to the third sub-pixel 30.

The first switching sub-circuit ST1 has a control terminal receiving a first strobe signal G1, a first terminal connected to an output terminal of the first driving transistor DT1, and a second terminal connected to a first detection line Sense1. The first switching sub-circuit ST1 is configured to be turned on in a first period in response to the first strobe signal G1 to transmit a driving current output by the first driving transistor DT1 to the first detection line Sense1. Then, the driving current is fed back to a driving module. After reading the driving current, the driving module calculates a required compensation voltage of the first sub-pixel 10, thus writing the compensation voltages to a first data signal Data-1 to achieve compensation for the first sub-pixel 10.

The second switching sub-circuit ST2 has a control terminal receiving a second strobe signal G2, a first terminal connected to an output terminal of the second driving transistor DT2, and a second terminal connected to the first detection line Sense1. The second switching sub-circuit ST2 is configured to be turned on in a second period in response to the second strobe signal G2, to transmit a driving current output by the second driving transistor DT2 to the first detection line Sense1. Then, the driving current is fed back to the driving module. After reading the driving current, the driving module calculates a required compensation voltage of the second sub-pixel 20, thus writing the compensation voltage to a second data signal Data-2 to achieve compensation for the second sub-pixel 20.

The third switching sub-circuit ST3 has a control terminal receiving the first strobe signal G1, a first terminal connected to an output terminal of the third driving transistor DT3, and a second terminal connected to a second detection line Sense2. The third switching sub-circuit ST3 is configured to be turned on in the first period in response to the first strobe signal G1, to transmit a driving current output by the third driving transistor DT3 to the second detection line Sense2. Then, the driving current is fed back to the driving module. After reading the driving current, the driving module calculates a required compensation voltage of the third sub-pixel 30, thus writing the compensation voltage to a third data signal Data-3 to achieve compensation for the third sub-pixel 30.

The first sub-pixel 10, the second sub-pixel 20, and the third sub-pixel 30 may respectively correspond to a red sub-pixel, a green sub-pixel, and a blue sub-pixel. Correspondingly, the first OLED light emitting unit, the second OLED light emitting unit, and the third OLED light emitting unit may respectively correspond to a red OLED light emitting unit, a green OLED light emitting unit, and a blue OLED light emitting unit.

Figure 2:
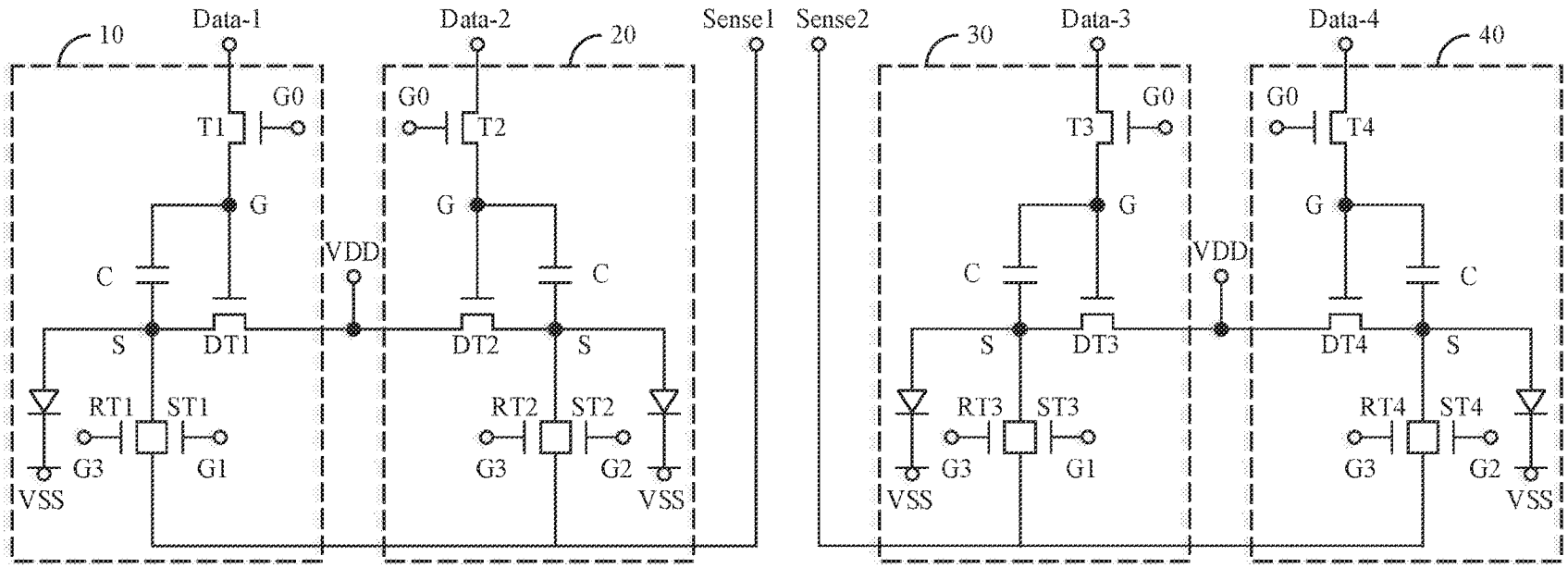
FIG. 2 schematically illustrates a schematic diagram 2 of a pixel driving compensation circuit in an exemplary arrangement of the present disclosure.

In the pixel driving compensation circuit provided by the exemplary arrangement of the present disclosure, the first sub-pixel 10 and the second sub-pixel 20 share the same detection line, but the switching sub-circuits thereof are respectively controlled by different strobe signals to be turned on in different periods. The first sub-pixel 10 and the third sub-pixel 30 use different detection lines, but the switching sub-circuits thereof are controlled by the same strobe signal to be turned on in the same period. Based on the structure, the first sub-pixel 10 and the third sub-pixel 30 can respectively detect the driving current by using the first detection line Sense1 and the second detection line Sense2 in the same period, and feed back the detection results to the driving module instantly. After reading the driving currents of the first sub-pixel 10 and the third sub-pixel 30, the driving module respectively calculates the required compensation voltages of the first and third sub-pixels 10 and 30, thus respectively writing the compensation voltages of the first sub-pixel 10 and the third sub-pixel 30 to the first data signal Data-1 and a third data signal Data-3 to achieve the compensations for the first sub-pixel 10 and the third sub-pixel 30. However, the second sub-pixel 20 can detect the driving current by using the first detection line Sense1 in another period, and feed back the detection result to the driving module instantly. After reading the driving current of the second sub-pixel 20, the driving module calculates the required compensation voltage of the second sub-pixel 20, thus writing the compensation voltage of the second sub-pixel 20 to the second data signal Data-2 to achieve the compensation for the second sub-pixel 20. In this way, the pixel structure combined with the working timing of the strobe signal can not only effectively shorten the current detection time to provide a basis for subsequent real-time compensation, thus shortening the occupation time of external compensation, but also separate the sub-pixels from each other to avoid the effect of defects in other sub-pixels, thus preventing the newly added defects after compensation from affecting the display effect of the display screen. Based on this, the sub-pixels in the OLED pixel unit are isolated from each other by the coordination action of the strobe signal and the detection line, thus ensuring the accuracy of current detection and compensation of each sub-pixel, effectively avoiding the problem of display abnormality, and improving display effect On the basis of this, as shown in FIG. 2, the OLED pixel unit may further include a fourth sub-pixel 40. The fourth sub-pixel 40 may include a fourth driving transistor DT4, a first terminal of the fourth driving transistor DT4 receives the first voltage signal VDD, and a second terminal of the fourth driving transistor DT4 is connected to the fourth OLED lighting unit.

Based on this, the OLED pixel driving compensation circuit may further include a fourth switching sub-circuit ST4 corresponding to the fourth sub-pixel 40.

The fourth switching sub-circuit ST4 has a control terminal receiving the second strobe signal G2, a first terminal connected to the output terminal of the fourth driving transistor DT4, and a second terminal connected to the second detection line Sense2. The fourth switching sub-circuit ST4 is configured to be turned on in response to the second strobe signal G2 in the second period, to transmit a driving current output by the fourth driving transistor DT4 to the second detection line Sense2. Then, the driving current is fed back to the driving module. After reading the driving current, the driving module calculates a required compensation voltage of the fourth sub-pixel 40, thus writing the compensation voltage to a fourth data signal Data-4 to achieve compensation for the fourth sub-pixel 40.

The fourth sub-pixel 40 may be a white sub-pixel, and correspondingly, the fourth OLED light-emitting unit may be a white OLED light-emitting unit.

Based on the OLED pixel structure described above, the first sub-pixel 10 and the second sub-pixel 20 share the first detection line Sense1, the third sub-pixel 30 and the fourth sub-pixel 40 share the second detection line Sense2, the first sub-pixel 10 and the third sub-pixel 30 detect the driving current in the first period, and the second sub-pixel 20 and the fourth sub-pixel 40 detect the driving current in the second period. In this way, the detection line with a one-for-two structure (that is, two sub-pixels connected to the same detection line) provided by the exemplary arrangement can not only effectively shorten the current detection time to provide a basis for subsequent real-time compensation, thus shortening the occupation time of external compensation, but also separate different sub-pixels from each other to avoid distortion of the compensation signal caused by signal interference, thus effectively overcoming the display abnormality.

Considering that the function of the first detection line Sense1 and the second detection line Sense2 is to acquire the driving current output by the driving transistor and based on this to compensate the driving current of each sub-pixel, the first detection line Sense1 and the second detection line Sense2 are also connected to a driving chip.

In the example arrangement, referring to FIG. 1 and FIG. 2, the pixel driving compensation circuit may further include a first reset sub-circuit RT1 corresponding to the first sub-pixel 10, having a control terminal connected to a third strobe signal G3, a first terminal connected to the first detection line Sense1, and a second terminal connected to the output terminal of the first driving transistor DT1, and configured to be turned on in response to the third strobe signal G3 to transmit a voltage signal of the first detection line Sense1 to an output terminal of the first driving transistor DT1. The pixel driving compensation circuit may further include a second reset sub-circuit RT2 corresponding to the second sub-pixel 20, having a control terminal connected to the third strobe signal G3, a first terminal connected to the first detection line Sense1, and a second terminal connected to the output terminal of the second driving transistor DT2, and configured to be turned on in response to the third strobe signal G3, to transmit a voltage signal of the first detection line Sense1 to the output terminal of the second driving transistor DT2. The pixel driving compensation circuit may further include a third reset sub-circuit RT3 corresponding to the third sub-pixel 30, having a control terminal connected to the third strobe signal G3, a first terminal connected to the second detection line Sense2, and a second terminal connected to the output terminal of the third driving transistor DT3, and configured to be turned on in response to the third strobe signal G3, to transmit a voltage signal of the second detection line Sense2 to the output terminal of the third driving transistor DT3. The pixel driving compensation circuit may further include a fourth reset sub-circuit RT4 corresponding to the fourth sub-pixel 40, having a control terminal connected to the third strobe signal G3, a first terminal connected to the second detection line Sense2, and a second terminal connected to the output terminal of the fourth driving transistor DT4, and configured to be turned on in response to the third strobe signal G3, to transmit a voltage signal of the second detection line Sense2 to the output terminal of the fourth driving transistor DT4.

It should be noted that the respective reset sub-circuit and the above-mentioned respective switching sub-circuit may constitute a double-switch structure for improving the resetting capability of each sub-pixel. Thus, it can be known that the working periods of the reset sub-circuit and the switching sub-circuit constituting the double-switch structure should have overlapping portion, that is, in the reset phase, the level state of the third strobe signal G3 should be consistent with the level states of the first strobe signal G1 and the second strobe signal G2.

In the present exemplary arrangement, when the OLED pixel unit includes only three sub-pixels, only the first to third reset sub-circuits RT1 to RT3 and the first to third switching sub-circuits ST1 to ST3 are required to form three pairs of double-switch structures. When the OLED pixel unit includes four sub-pixels, the fourth reset sub-circuit RT4 and the fourth switching sub-circuit ST4 are further required to form a fourth pair of double-switch structure.

In this way, for any sub-pixel, the resetting capability can be increased by forming a double-switch structure by the switching sub-circuit and the reset sub-circuit inside of the sub-pixel. In the field of high-frequency display, the resetting ability of the conventional OLED display is weak, and thus the display effect is poor. By adopting the OLED pixel structure provided by the exemplary arrangement, the reset capability can be improved, thus meeting the requirement of high frequency display, and an OLED display with good display effect is obtained.

It should be noted that, based on the pixel driving compensation circuit described above, the control terminals of the driving transistors of the respective sub-pixels may also respectively be connected to the data signal terminals through control switches such as control transistors. Specifically, for the first sub-pixel 10, the control terminal of the first driving transistor DT1 is connected to a first control transistor T1. A control terminal of the first control transistor T1 receives the control signal G0, a first terminal of the first control transistor T1 receives the first data signal Data-1, and a second terminal of the first control transistor T1 is connected to the control terminal of the first driving transistor DT1. For the second sub-pixel 20, the control terminal of the second driving transistor DT2 is connected to a second control transistor T2. A control terminal of the second control transistor T2 receives the control signal G0, a first terminal of the second control transistor T2 receives the second data signal Data-2, and a second terminal of the second control transistor T2 is connected to the control terminal of the second driving transistor DT2. For the third sub-pixel 30, the control terminal of the third driving transistor DT3 is connected to a third control transistor T3. A control terminal of the third control transistor T3 receives the control signal G0, a first terminal of the third control transistor T3 receives the third data signal Data-3, and a second terminal of the third control transistor T3 is connected to the control terminal of the third driving transistor DT3. For the fourth sub-pixel 40, the control terminal of the fourth driving transistor DT4 is connected to a fourth control transistor T4. A control terminal of the fourth control transistor T4 receives the control signal G0, a first terminal of the fourth control transistor T4 receives the fourth data signal Data-4, and a second terminal of the fourth control transistor T4 is connected to the control terminal of the fourth driving transistor DT4.

In the example arrangement, the first to fourth switching sub-circuits ST1 to ST4 may be first to fourth switching transistors, and the first to fourth reset sub-circuits RT1 to RT4 may be first to fourth reset transistor. All of the transistors may be N-type thin film transistors or P-type thin film transistors.

Figure 3:
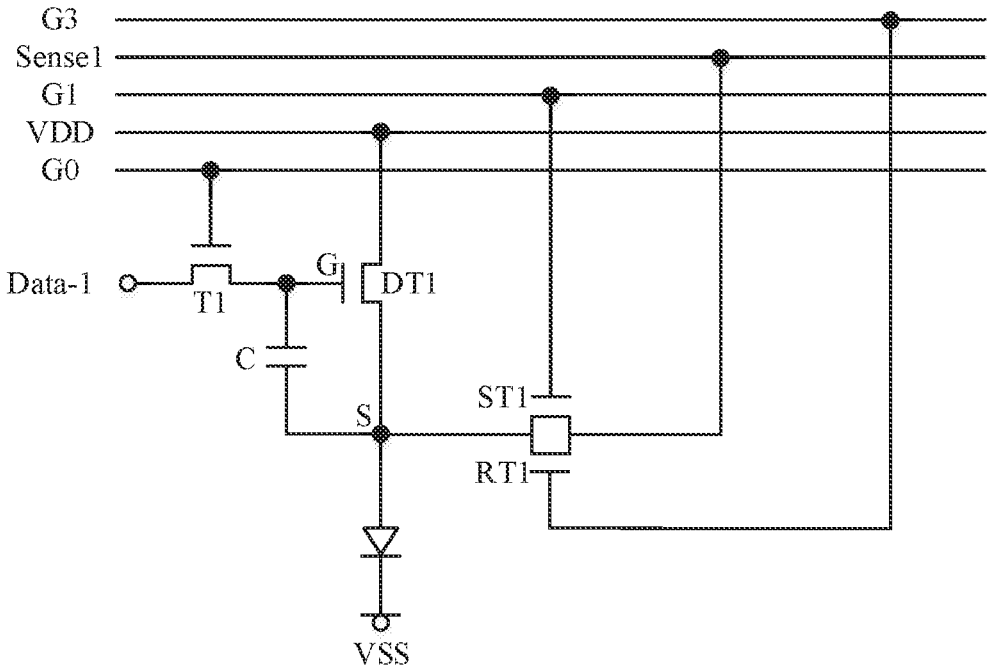
FIG. 3 schematically illustrates a circuit connection relationship of sub-pixels in an exemplary arrangement of the present disclosure.

Hereinafter, the sub-pixel connection relationship in the pixel driving compensation circuit will be exemplarily described with reference to FIG. 3 taking all of the switching sub-circuits/transistors as N-type thin film transistors as an example. The first sub-pixel is a red sub-pixel, and the first OLED light-emitting unit is a red light-emitting unit.

The red sub-pixel includes a first driving transistor DT1 and a red OLED lighting unit connected to an output terminal of the first driving transistor DT1, and an input terminal of the first driving transistor DT1 is connected to a first voltage signal VDD, such as a high level signal. The cathode of the red OLED light emitting unit is connected to a second voltage signal VSS, such as a low level signal. A control terminal of the first driving transistor DT1 is connected to the first control transistor T1, and the first control transistor T1 is used to transmit a data signal Data-1 to the control terminal of the first driving transistor DT1 in response to the control signal G0. The output terminal of the first driving transistor DT1 is further connected to the first switching sub-circuit ST1 and the first reset sub-circuit RT1, and the first switching sub-circuit ST1 is used to transmit the current output by the first driving transistor DT1 to the first detection line Sense1 in response to the first strobe signal G1. However, the first resetting sub-circuit RT1 is used to transmit the voltage signal of the first detection line Sense1 to the output terminal of the first driving transistor DT1 in response to the third strobe signal G3.

When the control signal G0 is at a high level, the first control transistor T1 is turned on, and the first data signal Data-1 is also a high level signal and is transmitted to the control terminal of the first driving transistor DT1. At this time, the first driving transistor DT1 is turned on, and outputs a driving current to the anode of the OLED unit under the action of the first voltage signal VDD to drive the OLED unit to emit light. At the same time, the first strobe signal G1 is at a high level, and the first switching sub-circuit ST1 is turned on, so that the current output by the first driving transistor DT1 is transmitted to the first detection line Sense1, thus realizing signal feedback of the output current. Further, the first detection line Sense1 can transmit the received signal to the driving chip, and the driving chip realizes compensation for the first sub-pixel by the first data signal Data-1. In the reset phase, the first strobe signal G1 and the third strobe signal G3 are both at a high level, and the first switching sub-circuit ST1 and the first reset sub-circuit RT1 are simultaneously turned on, so that the voltage signal of the first detection line Sense1, such as a low level signal, is transmitted to the output terminal of the first driving transistor DT1, thus rapidly pulling down the anode potential of the OLED lighting unit to complete the reset operation.

Figure 4:
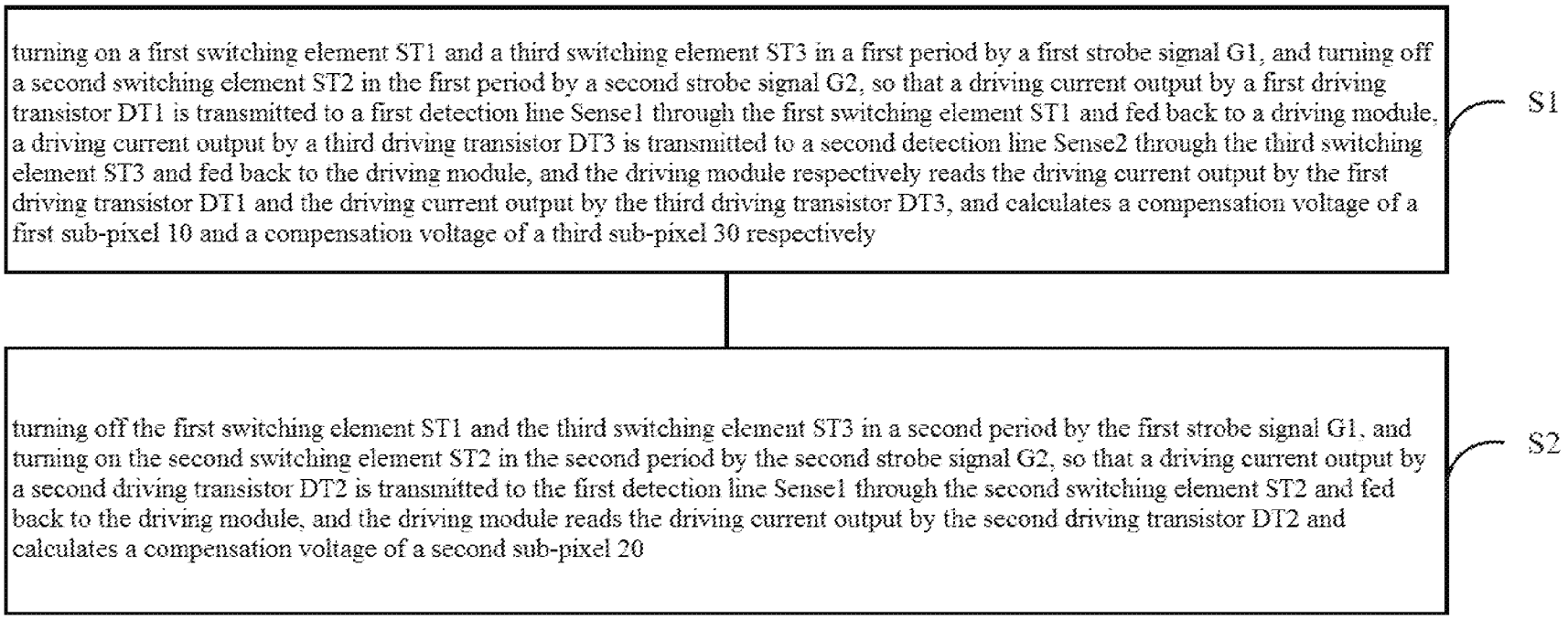
FIG. 4 schematically illustrates a flow chart 1 of a pixel driving compensation method in an exemplary arrangement of the present disclosure.

The example arrangement further provides a driving compensation method based on the pixel driving compensation circuit described above, for detecting and compensating a driving current of each sub-pixel in the pixel unit. As shown in FIG. 4, the driving compensation method may include the following blocks.

Block S1, turning on a first switching sub-circuit ST1 and a third switching sub-circuit ST3 in a first period by a first strobe signal G1, and turning off a second switching sub-circuit ST2 in the first period by a second strobe signal G2, so that a driving current output by a first driving transistor DT1 is transmitted to a first detection line Sense1 through the first switching sub-circuit ST1 and fed back to a driving module, a driving current output by a third driving transistor DT3 is transmitted to a second detection line Sense2 through the third switching sub-circuit ST3 and fed back to the driving module, and the driving module respectively reads the driving current output by the first driving transistor DT1 and the driving current output by the third driving transistor DT3, and calculates a compensation voltage of a first sub-pixel 10 and a compensation voltage of a third sub-pixel 30 respectively;

Block S2, turning off the first switching sub-circuit ST1 and the third switching sub-circuit ST3 in a second period by the first strobe signal G1, and turning on the second switching sub-circuit ST2 in the second period by the second strobe signal G2, so that a driving current output by a second driving transistor DT2 is transmitted to the first detection line Sense1 through the second switching sub-circuit ST2 and fed back to the driving module, and the driving module reads the driving current output by the second driving transistor DT2 and calculates a compensation voltage of a second sub-pixel 20.

It should be noted that if the first to third driving transistors DT1-DT3 output the driving currents, it needs that the first to third driving transistors DT1-DT3 are turned on and the first voltage signal VDD is input. Therefore, when performing the above blocks S1 and S2, the control transistors T1-T3 of the respective sub-pixels need to be turned on under the action of the control signal G0, so that the first to third data signals Data-1~Data-3 are respectively transmitted to the control terminals of the first to the third driving transistors DT1-DT3 to turn on the first to the third driving transistors DT1-DT3.

The pixel driving compensation method provided by the exemplary arrangement of the present disclosure, on the one hand, completes current detection of the first sub-pixel 10 and the third sub-pixel 30 connected to different detection lines in the same period, which saves detection time and provides a basis for subsequent real-time compensation, thus shortening the occupation time of external compensation; on the other hand, completes current detection of the first sub-pixel 10 and the second sub-pixel 20 sharing the same detection line in different periods, thus avoiding signal interference between different sub-pixels, preventing distortion of the compensation signal and thus improving the display effect.

Based on the above-described driving compensation method, it is mainly described that the OLED pixel unit has three sub-pixels. In the case that the OLED pixel unit further includes a fourth sub-pixel, the driving compensation method may further include: turning off a fourth switching sub-circuit ST4 in the first period by the second strobe signal G2 when turning on the first switching sub-circuit ST1 and the third switching sub-circuit ST3 in the first period by the first strobe signal G1, and turning off the second switching sub-circuit ST2 in the first period by the second strobe signal G2; and turning on the fourth switching sub-circuit ST4 in the second period by the second strobe signal G2 when turning off the first switching sub-circuit ST1 and the third switching sub-circuit ST3 in the second period by the first strobe signal G1, and turning on the second switching sub-circuit ST2 in the second period by the second strobe signal G2, so that a driving current output by a fourth driving transistor DT4 is transmitted to the second detection line Sense2 through the fourth switching sub-circuit ST4 and fed back to the driving module, and the driving module reads the driving current output by the fourth driving transistor DT4 and calculates a compensation voltage of the fourth sub-pixel 40.

Figure 5:
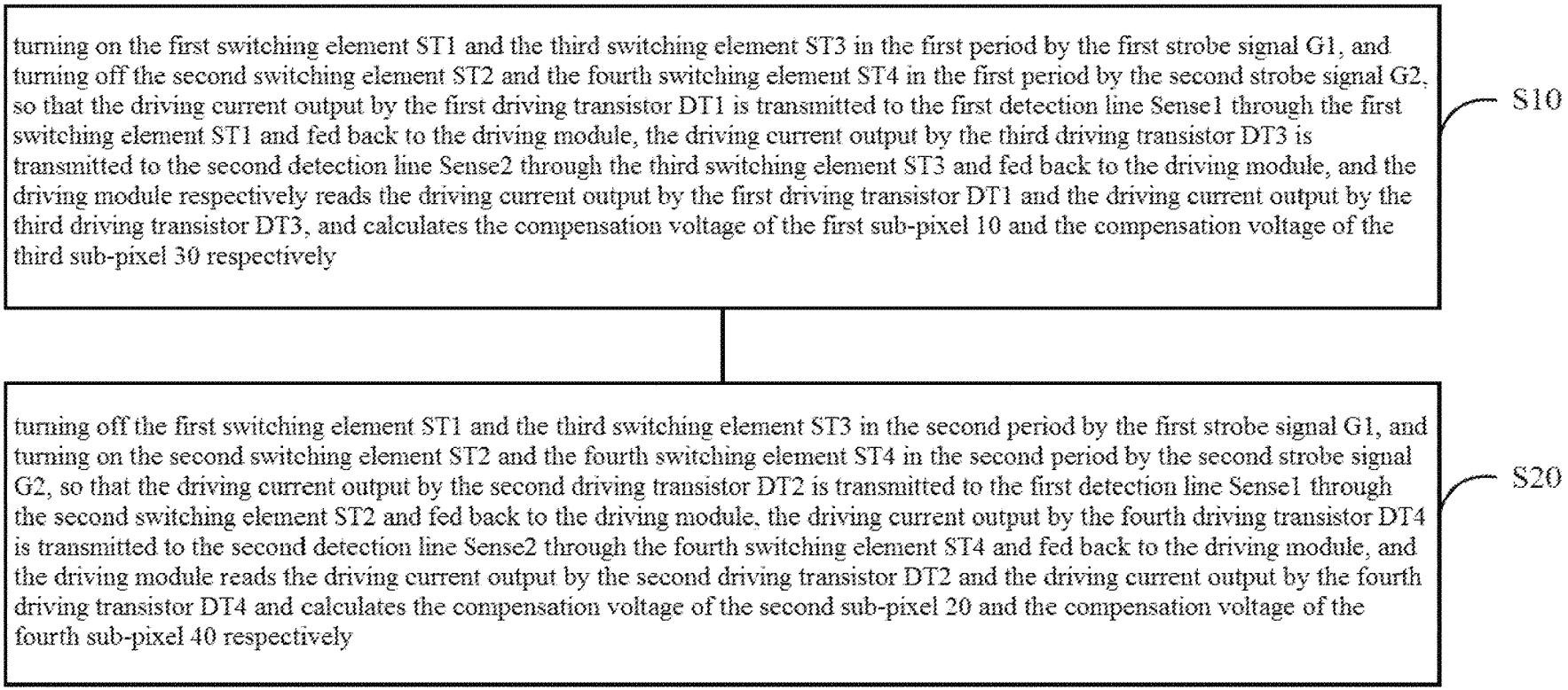
FIG. 5 schematically illustrates a flow chart 2 of a pixel driving compensation method in an exemplary arrangement of the present disclosure.

Based on this, in the case where the OLED pixel unit has four sub-pixels, as shown in FIG. 5, the driving compensation method may include the following blocks.

Block S10, turning on the first switching sub-circuit ST1 and the third switching sub-circuit ST3 in the first period by the first strobe signal G1, and turning off the second switching sub-circuit ST2 and the fourth switching sub-circuit ST4 in the first period by the second strobe signal G2, so that the driving current output by the first driving transistor DT1 is transmitted to the first detection line Sense1 through the first switching sub-circuit ST1 and fed back to the driving module, the driving current output by the third driving transistor DT3 is transmitted to the second detection line Sense2 through the third switching sub-circuit ST3 and fed back to the driving module, and the driving module respectively reads the driving current output by the first driving transistor DT1 and the driving current output by the third driving transistor DT3, and calculates the compensation voltage of the first sub-pixel 10 and the compensation voltage of the third sub-pixel 30 respectively;

Block S20, turning off the first switching sub-circuit ST1 and the third switching sub-circuit ST3 in the second period by the first strobe signal G1, and turning on the second switching sub-circuit ST2 and the fourth switching sub-circuit ST4 in the second period by the second strobe signal G2, so that the driving current output by the second driving transistor DT2 is transmitted to the first detection line Sense1 through the second switching sub-circuit ST2 and fed back to the driving module, the driving current output by the fourth driving transistor DT4 is transmitted to the second detection line Sense2 through the fourth switching sub-circuit ST4 and fed back to the driving module, and the driving module reads the driving current output by the second driving transistor DT2 and the driving current output by the fourth driving transistor DT4 and calculates the compensation voltage of the second sub-pixel 20 and the compensation voltage of the fourth sub-pixel 40 respectively.

It should be noted that if the first to fourth driving transistors DT1-DT4 output the driving current, it needs that the first to fourth driving transistors DT1-DT4 are turned on and the first voltage signal VDD is input. Therefore, when performing the above blocks S10 and S20, the control transistors T1-T4 of the respective sub-pixels need to be turned on under the action of the control signal G0, so that the first to fourth data signals Data-1~Data-4 are respectively transmitted to the control terminals of the first to the fourth driving transistors DT1-DT4 to turn on the first to the fourth driving transistors DT1-DT4.

In the present exemplary arrangement, the control terminals of the control transistors of the respective sub-pixels receive the same control signal G0, and thus the control signal G0 can simultaneously turn on or off the respective control transistors. The current detections of the first sub-pixel 10 and the third sub-pixel 30 are both in the first period. At this time, only the first driving transistor DT1 and the third driving transistor DT3 should be turned on and output current, but due to the action of the control signal G0, the second driving transistor DT2 and the fourth driving transistor DT4 are also turned on. In order to prevent the current output from the second driving transistor DT2 and/or the fourth driving transistor DT4 from disturbing the output current detection of the first sub-pixel 10 and/or the third sub-pixel 30, the second data signal Data-2 of the second sub-pixel 20 and the fourth data signal Data-4 of the fourth sub-pixel 40 are in a non-working period. Similarly, the current detections of the second sub-pixel 20 and the fourth sub-pixel 40 are both in the second period, and at this time, the first data signal Data-1 of the first sub-pixel 10 and the third data signal Data-3 of the third sub-pixel 30 may be in a non-working period.

In the present exemplary arrangement, for a P-type thin film transistor, a working period refers to a low-level period, and a non-working period refers to a high-level period; for an N-type thin film transistor, a working period refers to a high-level period and a non-working period refers to a low-level period.

Figure 6:
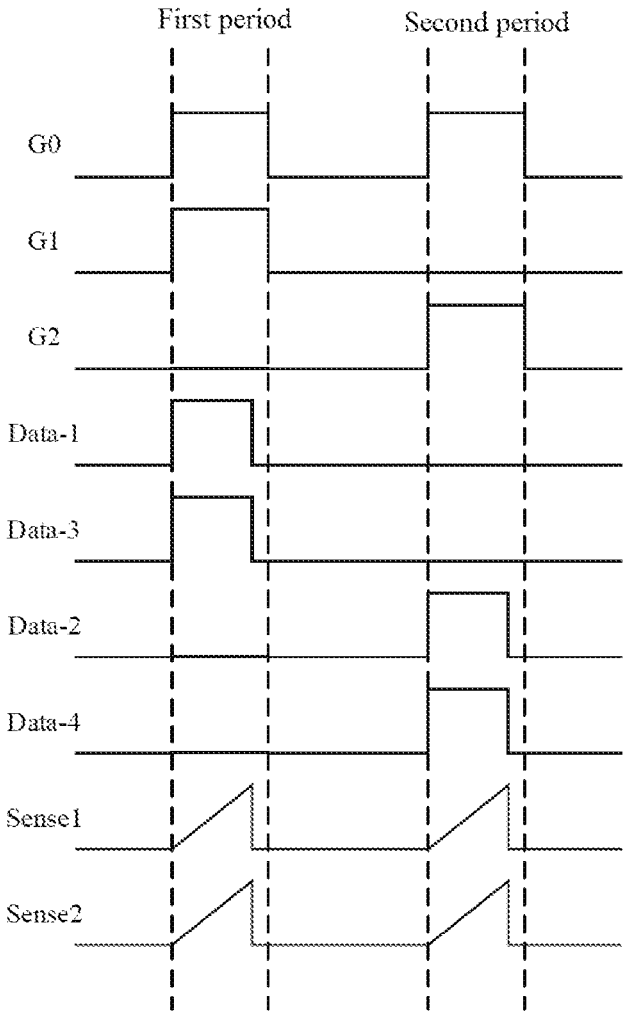
FIG. 6 schematically illustrates a driving timing diagram in an exemplary arrangement of the present disclosure.

Based on this, as shown in FIG. 6, in the compensation phase, the working periods of the first data signal Data-1 and the third data signal Data-3 may be the same as the working period of the first strobe signal G1, and the working periods of the second data signal Data-2 and the fourth data signal Data-4 can be the same as the working period of the second strobe signal G2, which can solve the problem of signal interference.

When the N-type thin film transistor is used in the present arrangement, the above description can be understood as: a high level period of the first data signal Data-1 of the first sub-pixel 10 and the third data signal Data-3 of the third sub-pixel 30 is the same as a high level period of the first strobe signal G1, and a high level period of a second data signal Data-2 of the second sub-pixel 20 and a fourth data signal Data-4 of the fourth sub-pixel 40 is the same as a high level period of the second strobe signal G2.

When the P-type thin film transistor is used in the present arrangement, the above description can be understood as: a low level period of the first data signal Data-1 of the first sub-pixel 10 and the third data signal Data-3 of the third sub-pixel 30 is the same as a low level period of the first strobe signal G1, and a low level period of a second data signal Data-2 of the second sub-pixel 20 and a fourth data signal Data-4 of the fourth sub-pixel 40 is the same as a low level period of the second strobe signal G2.

The driving compensation method provided by the example arrangement may implement detection and compensation of the output current of the driving transistor by the above method in the compensation phase, and in the reset phase may include turning on the first to third switching sub-circuits ST1-ST3 through the first strobe signal G1 and the second strobe signal G2, transmitting the voltage signal of the first detection line to the output terminals of the first driving transistor DT1 and the second driving transistor DT2 respectively and transmitting the voltage signal of the second detection line Sense2 to the output terminal of the third driving transistor DT3.

When the OLED pixel unit further includes a fourth sub-pixel, the driving compensation method further includes turning on the fourth switching sub-circuit ST4 by the second strobe signal G2, and transmitting the voltage signal of the second detection line Sense2 to the output terminal of the fourth driving transistor DT4.

In this way, the reset function can be realized by the switching sub-circuits ST1-ST4 of the respective sub-pixels in the reset phase. However, in the field of high-frequency display, if only a single switching sub-circuit is used for resetting, the resetting ability is weak, which may cause a problem of poor display effect. Therefore, a resetting sub-circuit and the above switching sub-circuit may constitute a double-switching structure to enhance the resetting ability.

On the basis of the above, the driving compensation method in the reset phase may further include: turning on the first to third reset sub-circuits RT1~RT3 respectively by a third strobe signal G3, transmitting the voltage signal of the first detection line Sense1 to the output terminals of the first driving transistor DT1 and the second driving transistor DT2 respectively and transmitting the voltage signal of the second detection line to the output terminal of the third driving transistor DT3.

Of course, when the OLED pixel unit further includes the fourth sub-pixel, the driving compensation method further includes: turning on the fourth reset sub-circuit RT4 by a third strobe signal G3, and transmitting a voltage signal of the second detection line Sense2 to an output terminal of the fourth driving transistor DT4.

The first switching sub-circuit ST1 and the first reset sub-circuit RT1 are simultaneously turned on, the second switching sub-circuit ST2 and the second reset sub-circuit RT2 are simultaneously turned on, the third switching sub-circuit ST3 and the third reset sub-circuit RT3 are simultaneously turned on, and the fourth switching sub-circuit ST4 and the fourth reset sub-circuit RT4 are simultaneously turned on.

Hereinafter, taking all of the switching sub-circuits/transistors as N-type thin film transistors as an example, the pixel driving compensation method in the present exemplary arrangement will be described in detail with reference to FIGS. 2 and 6.

In the compensation phase, the first sub-pixel 10 and the third sub-pixel 30 perform detection and compensation of the output current of the driving transistor in the first period, and the second sub-pixel 20 and the fourth sub-pixel 40 perform detection and compensation of the output current of the driving transistor in the second period.

In the first period, the control signal G0 and the first strobe signal G1 are at a high level, the first data signal Data-1 and the third data signal Data-3 are at a high level, and the first control transistor T1 is turned on to transmit the first data signal Data-1 to the control terminal of the first driving transistor DT1, and then the first driving transistor DT1 is turned on to transmit the first voltage signal VDD to the anode of the first OLED light emitting unit, and the first switching sub-circuit ST1 is turned on to transmit the output current of the first driving transistor DT1 to the first detection line Sense1. Similarly, the third control transistor T3 is turned on to transmit the third data signal Data-3 to the control terminal of the third driving transistor DT3, and then the third driving transistor DT3 is turned on to transmit the first voltage signal VDD to the anode of the third OLED lighting unit, and the third switching sub-circuit ST3 is turned on to transmit the output current of the third driving transistor DT3 to the second detection line Sense2. The first detection line Sense1 and the second detection line Sense2 respectively transmit the received current signals to the driving chip, and the current signals are respectively compensated after calculation processing.

In the second period, the control signal G0 and the second strobe signal G2 are at a high level, the second data signal Data-2 and the fourth data signal Data-4 are at a high level, the second control transistor T2 is turned on to transmit the second data signal Data-2 to the control terminal of the second driving transistor DT2, and then the second driving transistor DT2 is turned on to transmit the first voltage signal VDD to the anode of the second OLED lighting unit, and the second switching sub-circuit ST2 is turned on to transmit the output current of the second driving transistor DT2 to the first detection line Sense1. Similarly, the fourth control transistor T4 is turned on to transmit the fourth data signal Data-4 to the control terminal of the fourth driving transistor DT4, and then the fourth driving transistor DT4 is turned on to transmit the first voltage signal VDD to the anode of the fourth OLED lighting unit, and the fourth switching sub-circuit ST4 is turned on to transmit the output current of the fourth driving transistor DT4 to the second detection line Sense2. The first detection line Sense1 and the second detection line Sense2 respectively transmit the received current signals to the driving chip, and the current signals are respectively compensated after calculation processing.

Through the above detection and compensation method, the respective sub-pixels can be separated from each other, thus avoiding the defect in a certain sub-pixel from affecting the data of other sub-pixels during the current detection and resulting in abnormal display after compensation, and also shortening the detection time and providing technical support for real-time compensation, which shortens the occupation time of external compensation.

In the reset phase, the first detection line Sense1 and the second detection line Sense2 provide a reset signal such as a low level signal, a control signal G0, a first strobe signal G1, a second strobe signal G2, and a third strobe signal G3 are all at a high level, and the first to fourth control transistors T1 to T4, the first to fourth switching sub-circuits ST1 to ST4, and the first to fourth reset sub-circuits RT1 to RT4 are all turned on, the first switching sub-circuit ST1 and the first reset sub-circuit RT1 constitute a first switch pair, the second switch sub-circuit ST2 and the second reset sub-circuit RT2 constitute a second switch pair, the third switch sub-circuit ST3 and the third reset sub-circuit RT3 constitute a third switch pair, and the fourth switch sub-circuit ST4 and the fourth reset sub-circuit RT4 constitute a fourth switch pair. Based on the switch pair structure, the anode potential of each OLED light emitting unit can be quickly pulled down, thus completing the writing data and the reset operation.

It should be noted that the specific details of the pixel driving compensation method have been described in detail in the corresponding pixel driving compensation circuit, and details are not described herein again.

It should be noted that although modules or units of devices for executing functions are described above, such division of modules or units is not mandatory. In fact, features and functions of two or more of the modules or units described above may be embodied in one module or unit in accordance with the arrangements of the present disclosure. Alternatively, the features and functions of one module or unit described above may be further divided into multiple modules or units.

In addition, although the various blocks of the method of the present disclosure are described in a particular order in the figures, this is not required or implied that the blocks must be performed in the specific order, or all the blocks shown must be performed to achieve the desired result. Additionally or alternatively, certain blocks may be omitted, multiple blocks may be combined into one block, and/or one block may be decomposed into multiple blocks and so on.

Through the description of the above arrangements, those skilled in the art will readily understand that the exemplary arrangements described herein may be implemented by software or by a combination of software with necessary hardware. Therefore, the technical solutions according to arrangements of the present disclosure may be embodied in the form of a software product, which may be stored in a non-volatile storage medium (which may be a CD-ROM, a USB flash drive, a mobile hard disk, etc.) or on a network. A number of instructions are included to cause a computing device (which may be a personal computer, server, mobile terminal, or network device, etc.) to perform the methods in accordance with the arrangements of the present disclosure.

Other arrangements of the present disclosure will be apparent to those skilled in the art after considering the specification and practicing the present disclosure. The present application is intended to cover any variations, uses, or adaptations of the present disclosure, which are in accordance with the general principles of the present disclosure and include common general knowledge or conventional technical means in the art that are not disclosed in the present disclosure. The specification and arrangements are illustrative, and the real scope and spirit of the present disclosure is defined by the appended claims.

What is claimed is:

1. A pixel driving compensation circuit for detecting and compensating a driving current of a sub-pixel in a pixel unit, wherein the pixel unit comprises first, second, and third sub-pixels and the first to third sub-pixels respectively comprise first, second, third driving transistors, the pixel driving compensation circuit comprising:

a first switching sub-circuit configured to be turned on in a first period in response to a first strobe signal to transmit a driving current output from the first driving transistor to a first detection line;

a second switching sub-circuit configured to be turned on in a second period in response to a second strobe signal to transmit a driving current output from the second driving transistor to the first detection line; and a third switching sub-circuit configured to be turned on in the first period in response to the first strobe signal to transmit a driving current output from the third driving transistor to a second detection line.

2. The pixel driving compensation circuit according to claim 1, wherein the pixel unit further comprises a fourth sub-pixel and the fourth sub-pixel comprises a fourth driving transistor; and the pixel driving compensation circuit further comprises:

a fourth switching sub-circuit configured to be turned on in the second period in response to the second strobe signal to transmit a driving current output from the fourth driving transistor to the second detection line.

3. The pixel driving compensation circuit according to claim 2, wherein the first to fourth sub-pixels comprise: a red sub-pixel, a green sub-pixel, a blue sub-pixel, and a white sub-pixel.

4. The pixel driving compensation circuit according to claim 1, wherein the pixel driving compensation circuit further comprises:

a first reset sub-circuit configured to be turned on in response to a third strobe signal to transmit a voltage signal of the first detection line to an output terminal of the first driving transistor;

a second reset sub-circuit configured to be turned on in response to the third strobe signal transmit the voltage signal of the first detection line to an output terminal of the second driving transistor; and a third reset sub-circuit configured to be turned on in response to the third strobe signal to transmit a voltage signal of the second detection line is transmitted to an output terminal of the third driving transistor.

5. The pixel driving compensation circuit according to claim 4, wherein the pixel unit further comprises a fourth sub-pixel and the fourth sub-pixel comprises a fourth driving transistor; and the pixel driving compensation circuit further comprises:

a fourth switching sub-circuit configured to be turned on in the second period in response to the second strobe signal transmit a driving current output from the fourth driving transistor to the second detection line, wherein the pixel driving compensation circuit further comprises:

a fourth reset sub-circuit configured to be turned on in response to the third strobe signal to transmit the voltage signal of the second detection line to an output terminal of the fourth driving transistor.

6. The pixel driving compensation circuit according to claim 5, wherein each of the first, second, third, and fourth switching sub-circuits and the first, second, third, and fourth reset sub-circuits is an N-type thin film transistor.

7. The pixel driving compensation circuit according to claim 5, wherein each of the first, second, third, and fourth switching sub-circuits and the first, second, third, and fourth reset sub-circuits is a P-type thin film transistor.

8. The pixel driving compensation circuit according to claim 1, wherein the first detection line and the second detection line are further connected to a driving chip.

9. A driving compensation method for detecting and compensating a driving current of a sub-pixel in a pixel unit, wherein the pixel unit comprises first, second, and third sub-pixels and the first to third sub-pixels respectively comprise first, second, and third driving transistors, the driving compensation method comprising:

turning on a first switching sub-circuit and a third switching sub-circuit in a first period by a first strobe signal, and turning off a second switching sub-circuit in the first period by a second strobe signal, so that a driving current output from a first driving transistor is transmitted to a first detection line through the first switching sub-circuit and fed back to a driving module, a driving current output from a third driving transistor is transmitted to a second detection line through the third switching sub-circuit and fed back to the driving module, and the driving module respectively reads the driving current output from the first driving transistor and the driving current output from the third driving transistor, and calculates a compensation voltage of a first sub-pixel and a compensation voltage of a third sub-pixel; and turning off the first switching sub-circuit and the third switching sub-circuit in a second period by the first strobe signal, and turning on the second switching sub-circuit in the second period by the second strobe signal, so that a driving current output from a second driving transistor is transmitted to the first detection line through the second switching sub-circuit and fed back to the driving module, and the driving module reads the driving current output from the second driving transistor and calculates a compensation voltage of a second sub-pixel.

10. The driving compensation method according to claim 9, wherein the pixel unit further comprises a fourth sub-pixel and the fourth sub-pixel comprises a fourth driving transistor, and the driving compensation method further comprises:

turning off a fourth switching sub-circuit in the first period by the second strobe signal when turning on the first switching sub-circuit and the third switching sub-circuit in the first period by the first strobe signal, and turning off the second switching sub-circuit in the first period by the second strobe signal; and turning on the fourth switching sub-circuit in the second period by the second strobe signal when turning off the first switching sub-circuit and the third switching sub-circuit in the second period by the first strobe signal, and turning on the second switching sub-circuit in the second period by the second strobe signal, so that a driving current output from a fourth driving transistor is transmitted to the second detection line through the fourth switching sub-circuit and fed back to the driving module, and the driving module reads the driving current output from the fourth driving transistor and calculates a compensation voltage of the fourth sub-pixel.

11. The driving compensation method according to claim 10, wherein in a compensation phase, a high level period of a first data signal of the first sub-pixel and a third data signal of the third sub-pixel is the same as a high level period of the first strobe signal, and a high level period of a second data signal of the second sub-pixel and a fourth data signal of the fourth sub-pixel is the same as a high level period of the second strobe signal.

12. The driving compensation method according to claim 10, wherein in a compensation phase, a low level period of the first data signal of the first sub-pixel and the third data signal of the third sub-pixel is the same as a low-level period of the first strobe signal, and a low level period of the second data signal of the second sub-pixel and the fourth data signal of the fourth sub-pixel is the same as a low level period of the second strobe signal.

13. The driving compensation method according to claim 10 wherein the driving compensation method further comprises:

turning on the fourth switching sub-circuit by the second strobe signal, and transmitting a voltage signal of the second detection line to an output terminal of the fourth driving transistor.

14. The driving compensation method according to claim 10, wherein the driving compensation method further comprises:

turning on a fourth reset sub-circuit by a third strobe signal, to transmit a voltage signal of the second detection line to an output terminal of the fourth driving transistor;

wherein the fourth switching sub-circuit and the fourth reset sub-circuit are simultaneously turned on.

15. The driving compensation method according to claim 9, wherein the driving compensation method further comprises:

turning on the first to third switching sub-circuit through the first strobe signal and the second strobe signal, transmitting a voltage signal of the first detection line to output terminals of the first driving transistor and the second driving transistor respectively and transmitting a voltage signal of the second detection line to an output terminal of the third driving transistor.

16. The driving compensation method according to claim 9, wherein the driving compensation method further comprises:

turning on a first reset sub-circuit by a third strobe signal, to transmit the voltage signal of the first detection line to an output terminal of the first driving transistor, turning on a second reset sub-circuit by the third strobe signal, to transmitting the voltage signal of the first detection line to an output terminal of the second driving transistor, and turning on the third reset sub-circuit by the third strobe signal, to transmit the voltage signal of the second detection line to an output terminal of the third driving transistor, wherein the first switching sub-circuit and the first reset sub-circuit are simultaneously turned on, the second switching sub-circuit and the second reset sub-circuit are simultaneously turned on, and the third switching sub-circuit and the third reset sub-circuit are simultaneously turned on.

17. A display device, comprising a pixel driving compensation circuit for detecting and compensating a driving current of a sub-pixel in a pixel unit, wherein the pixel unit comprises first, second, and third sub-pixels and the first to third sub-pixels respectively comprise first, second, and third driving transistors, and the pixel driving compensation circuit comprises:

a first switching sub-circuit, configured to be turned on in a first period in response to a first strobe signal, to transmit a driving current output from the first driving transistor to a first detection line;

a second switching sub-circuit, configured to be turned on in a second period in response to a second strobe signal, to transmit a driving current output from the second driving transistor to the first detection line; and a third switching sub-circuit, configured to be turned on in the first period in response to the first strobe signal, to transmit a driving current output from the third driving transistor to a second detection line.

18. The display device according to claim 17, wherein the pixel unit further comprises a fourth sub-pixel and the fourth sub-pixel comprises a fourth driving transistor; and the pixel driving compensation circuit further comprises:

a fourth switching sub-circuit, configured to be turned on in the second period in response to the second strobe signal, to transmit a driving current output from the fourth driving transistor to the second detection line.

19. The display device according to claim 17, wherein the pixel driving compensation circuit further comprises:

a first reset sub-circuit, configured to be turned on in response to a third strobe signal, to transmit a voltage signal of the first detection line to an output terminal of the first driving transistor;

a second reset sub-circuit, configured to be turned on in response to the third strobe signal, transmit the voltage signal of the first detection line to an output terminal of the second driving transistor; and a third reset sub-circuit, configured to be turned on in response to the third strobe signal, to transmit a voltage signal of the second detection line is transmitted to an output terminal of the third driving transistor.

20. The display device according to claim 19, wherein the pixel unit further comprises a fourth sub-pixel and the fourth sub-pixel comprises a fourth driving transistor; and the pixel driving compensation circuit further comprises:

a fourth switching sub-circuit, configured to be turned on in the second period in response to the second strobe signal, transmit a driving current output from the fourth driving transistor to the second detection line, wherein, the pixel driving compensation circuit further comprises:

a fourth reset sub-circuit, configured to be turned on in response to the third strobe signal, to transmit the voltage signal of the second detection line to an output terminal of the fourth driving transistor.

* * * * *